US009346073B2

(12) United States Patent
Kida et al.

(10) Patent No.: US 9,346,073 B2
(45) Date of Patent: May 24, 2016

(54) COATED WEB MANUFACTURING MACHINE

(75) Inventors: Shinzo Kida, Tokyo (JP); Takafumi Izumiya, Tokyo (JP); Yuzuru Sakuma, Tokyo (JP); Yasumasa Tominaga, Higashihiroshima (JP); Hiroyuki Nakashima, Higashihiroshima (JP)

(73) Assignee: JAPAN TOBACCO INC., Tokyo (JP)

( * ) Notice: Subject to any disclaimer, the term of this patent is extended or adjusted under 35 U.S.C. 154(b) by 354 days.

(21) Appl. No.: 13/094,252

(22) Filed: Apr. 26, 2011

(65) Prior Publication Data

US 2011/0200747 A1 Aug. 18, 2011

Related U.S. Application Data

(63) Continuation of application No. PCT/JP2009/068255, filed on Oct. 23, 2009.

(30) Foreign Application Priority Data

Oct. 27, 2008 (JP) ..... 2008-275387

(51) Int. Cl.

| | |
|---|---|
| ***B05C 11/00*** | (2006.01) |
| ***B05C 1/08*** | (2006.01) |
| ***A24C 5/00*** | (2006.01) |
| ***A24D 1/02*** | (2006.01) |
| ***B05C 1/16*** | (2006.01) |

(Continued)

(52) U.S. Cl.

CPC ..... *B05C 1/0826* (2013.01); *A24C 5/005* (2013.01); *A24D 1/025* (2013.01); *B05C 1/165* (2013.01); *D21H 23/56* (2013.01); *B05C 1/10* (2013.01); *B05C 9/04* (2013.01); *D21H 19/68* (2013.01)

(58) Field of Classification Search

None

See application file for complete search history.

(56) References Cited

U.S. PATENT DOCUMENTS 3,120,449 A * 2/1964 Griswold ..... D04H 1/66 118/212
3,540,410 A * 11/1970 Osborne, Jr. et al. ..... 118/249

(Continued)

FOREIGN PATENT DOCUMENTS

JP 49-124143 A 11/1974
JP 2-14004 A 1/1990

(Continued)

OTHER PUBLICATIONS

International Search Report, dated Dec. 22, 2009 in PCT/JP2009/068255.

(Continued)

*Primary Examiner* — Charles Capozzi

(74) *Attorney, Agent, or Firm* — Birch, Stewart, Kolasch & Birch, LLP

(57) ABSTRACT

A manufacturing machine for manufacturing a wrapping paper web for cigarettes with a low ignition propensity has a coating device (3) at a coating position defined in a travel path (2) of web (W). The coating device (3) has a rotary screen (4) and a gravure roller (6) located on the opposite sides of the travel path (2) and functioning as back rollers for each other. The rotary screen (4) intermittently applies a liquid burning inhibitor onto one side of the web (W) to form a number of band layers (B) arranged at predetermined intervals in a travelling direction of the web (W), and the gravure roller (6) applies water onto the other side of the web (W) to form wet bands (A) arranged alternately with the band layers (B) in the traveling direction of the web (W).

14 Claims, 4 Drawing Sheets

(51) Int. Cl.

| | |
|---|---|
| ***D21H 23/56*** | (2006.01) |
| *B05C 1/10* | (2006.01) |
| *B05C 9/04* | (2006.01) |
| *D21H 19/68* | (2006.01) |

(56) References Cited

U.S. PATENT DOCUMENTS

| | | | | |
|---|---|---|---|---|
| 3,552,353 | A * | 1/1971 | Labombarde | 118/70 |
| 3,899,615 | A | 8/1975 | Wallsten | |
| 5,015,317 | A * | 5/1991 | Corey et al. | 156/197 |
| 5,393,566 | A * | 2/1995 | Propst | B65D 65/42 118/248 |
| 5,476,567 | A * | 12/1995 | Fujisawa | B29B 15/122 118/104 |
| 5,950,538 | A * | 9/1999 | Puschnerat | 101/217 |
| 6,263,791 | B1 * | 7/2001 | Sato | 101/116 |
| 6,364,950 | B1 * | 4/2002 | Cornell et al. | 118/264 |
| 7,329,622 | B1 * | 2/2008 | Ulli | 442/149 |
| 2002/0139381 | A1 | 10/2002 | Peterson et al. | |
| 2005/0115494 | A1 * | 6/2005 | Tietz et al. | 118/68 |
| 2008/0166494 | A1 * | 7/2008 | Price et al. | 427/492 |
| 2010/0297351 | A1 | 11/2010 | Kida et al. | |

FOREIGN PATENT DOCUMENTS

| | | | |
|---|---|---|---|
| JP | 6-286106 | A | 10/1994 |
| JP | 2003-136669 | A | 5/2003 |
| JP | 2004-512849 | A | 4/2004 |
| JP | 2008-155073 | A | 7/2008 |
| JP | 2008155073 | A * | 7/2008 |
| WO | WO 02/37991 | A1 | 5/2002 |
| WO | WO 02/055294 | A1 | 7/2002 |
| WO | WO 2009/09911 | A1 | 8/2009 |

OTHER PUBLICATIONS

International Searching Authority, dated Dec. 22, 2009 in PCT/JP2009/068255.

* cited by examiner

COATED WEB MANUFACTURING MACHINE

CROSS REFERENCE TO RELATED APPLICATIONS

This application is a Continuation of PCT International Application No. PCT/JP2009/068255 filed on Oct. 23, 2009, and for which priority is claimed under 35 U.S.C. §120; and this application claims priority of Application No. 2008-275387 filed in Japan on Oct. 27, 2008 under 35 U.S.C. §119; the entire contents of all of the above applications is hereby incorporated by reference.

TECHNICAL FIELD

The invention relates to a machine manufacturing a coated web that is the web coated with material, and a manufacturing method thereof.

BACKGROUND ART

A well-known coated web of this type is, for example, a wrapping paper web that is used as wrapping paper for cigarettes with a low ignition propensity. The wrapping paper web includes a plurality of band layers formed by coating one side of the web with a burning inhibitor. These band layers extend across the full width of the wrapping paper web, that is, around the entire circumference of a cigarette, and are arranged at predetermined intervals in a longitudinal direction of the wrapping paper web.

According to a cigarette with a low ignition propensity, which is fabricated with the above-mentioned wrapping paper web, even if this cigarette falls on a flammable material while burning, the band layers made of the burning inhibitor decrease the chance of fire spreading to the flammable material and thus improve the safety of the cigarette.

The wrapping-paper-web manufacturing machine and method are disclosed, for example, in Patent Document 1 below. According to Patent Document 1, a liquid burning inhibitor is intermittently applied to one side of the web while the web travels, and the band layers are thus formed. The band layers are subsequently dried, and a wrapping paper web is fabricated. More specifically, the burning inhibitor is applied onto the web in several batches to reduce wrinkles appearing in the wrapping paper web. Every time the burning inhibitor is applied, the band layer is dried.

[Patent Document 1] Kohyo No. 2004-512849

DISCLOSURE OF THE INVENTION

Problem to be Solved by the Invention

In the case of the manufacturing machine and method disclosed in Patent Document 1, the manufacture of the wrapping paper web uses more than one coating device and drying device, and therefore requires a wide space for installation of these devices, enlarging the scale of the entire wrapping-paper-web manufacturing machine.

It is an object of the invention to provide a manufacturing machine and method capable of simply and easily manufacturing a coated web.

Means for Solving the Problem

In order to achieve the above object, a coated web manufacturing machine of the invention comprises a travel path adapted to travel web along said travel path, said travel path including a coating position defined in said travel path, and a coating device located at the coating position of the travel path. The coating device includes a first applicator for applying a first coating liquid onto one side of web and a second applicator for applying a second coating liquid onto the other side of the web.

According to the manufacturing machine, when the web passes through the coating position of the travel path, the first and coating liquids are simultaneously applied onto both the sides of the web. After the web passes through the coating position, therefore, both the sides of the web are wet with the first and second coating liquids.

The manufacturing machine may comprise a drying device interposed in the travel path to be located downstream of the coating device and dries the web. In a web-drying process of the drying device, both the sides of the web are simultaneously died by the drying device.

The first and second applicators are both of a wheel type, and have plate cylinders for applying the first and second coating liquids onto the web. For example, either one of the first and second applicators has a rotary screen serving as a plate cylinder, while the other applicator functions as aback roller for the rotary screen. The rotary screen also functions as a back roller for the plate cylinder of the other applicator.

The coating device may further include a drive motor common to the plate cylinders of the first and second applicators and a gear train for transmitting a driving force from the drive motor to the plate cylinders of the first and second applicators. Alternatively, the coating device may further include a drive motor provided to each of the plate cylinders of the first and second applicators, and a synchronization mechanism for synchronizing rotations of the plate cylinders of the first and second applicators.

When the web is used for manufacturing cigarettes, the first applicator intermittently applies a liquid burning inhibitor functioning as the first coating liquid onto one side of the web, and thus forms a number of band layers arranged at predetermined intervals in a travelling direction of the web and made of burning inhibitor, whereas the second applicator applies aqueous humor functioning as the second coating liquid onto areas on the other side of the web, which coincide with intervals between the band layers of the one side of the web.

More specifically, the liquid burning inhibitor is an aqueous solution of sodium alginate, and the aqueous humor is water.

The invention further provides a coating web manufacturing method. The manufacturing method comprises steps of travelling web along a travel path, and applying first coating liquid onto one side of the web and second coating liquid onto the other side of the web at the same time when the web passes through a coating position defined in the travel path.

Technical Advantage of the Invention

Since the manufacturing machine and method of the invention simultaneously apply the first and second coating liquids on both the sides of the web at the coating position defined in the travel path of the web, the first and second coating liquids are simultaneously dried in a subsequent web-drying process. This considerably reduces wrinkles appearing in the web after the drying process.

The travel path requires only one coating position and one drying position; in other words, there only has to be one coating device and one drying device to be installed in the coating position and the drying position, respectively. This makes it possible to not only reduce the length of the manufacturing machine extending along the travel path but also simplify the construction of the entire manufacturing machine.

BEST MODE FOR CARRYING OUT THE INVENTION

Figure 1:
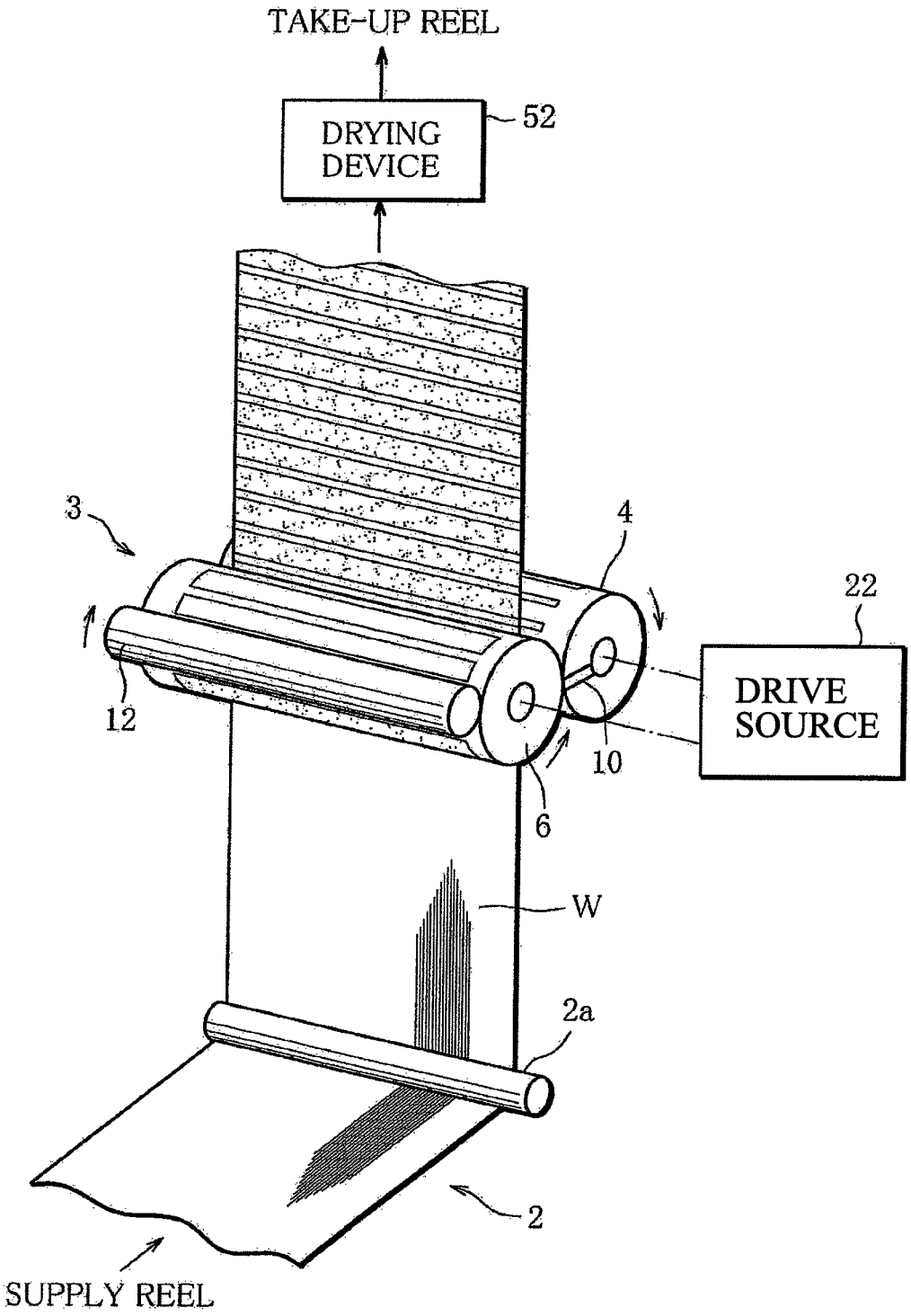
FIG. 1 is a schematic perspective view showing a manufacturing machine according to one embodiment.

FIG. 1 shows a coating web manufacturing machine and method according to one embodiment. This manufacturing machine manufactures a coated web that is used as wrapping paper for cigarettes with a low ignition propensity.

The manufacturing machine shown in FIG. 1 includes a travel path 2 for web W. The travel path 2 extends between a supply reel of the web W and a take-up reel of the web W. The web W is accordingly reeled off from the supply reel along the travel path 2. The web W that has been reeled off is taken up by the take-up reel. The travel path 2 is formed of a number of guide rollers, among which a guide roller 2*a* is shown in FIG. 1.

A coating position is defined in the travel path 2. A coating device 3 is placed at the coating position. The coating device 3 includes a plate cylinder of a first applicator, namely, a rotary screen 4. The rotary screen 4 is rotatably placed on one side of the travel path 2, and expands in a direction intersecting the travel path 2, or the web W. The coating device 3 further includes a plate cylinder of a second applicator, or a gravure roller 6. The gravure roller 6 cooperates with the rotary screen 4 to pinch the travel path 2 between the roller 6 and screen 4, and is rotatably arranged. The gravure roller 6 also extends in a direction intersecting the travel path 2, or the web W. The rotary screen 4 and the gravure roller 6 extend parallel with each other, and function as back rollers for each other.

Figure 2:
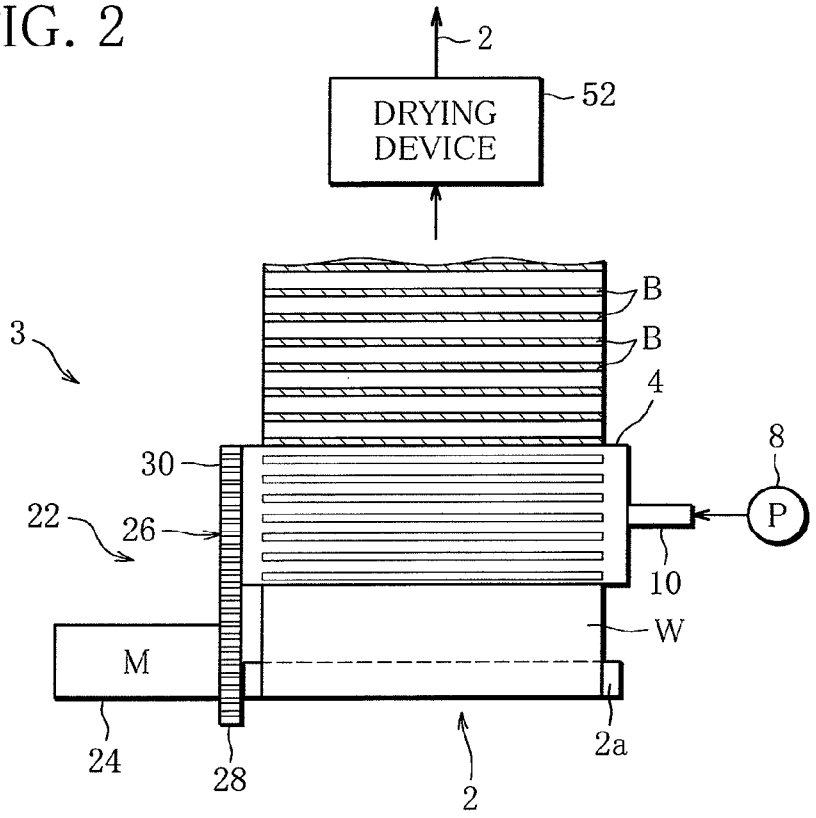
FIG. 2 is a view of a coating device of FIG. 1 as viewed from a rotary screen.

As illustrated in FIG. 2, the rotary screen 4 is connected to a pump 8. The pump 8 is capable of supplying a liquid burning inhibitor as a first coating liquid into the rotary screen 4. During the travel of the web W, when the web W passes the coating position, that is, passes between the rotary screen 4 and the gravure roller 6, the rotary screen 4 applies the liquid burning inhibitor onto one side of the web W in cooperation with the gravure roller 6 as a back roller and a squeegee 10, thereby forming a number of band layers B in the web W in a predetermined pattern.

In FIG. 2, the band layers B are shown with hatching. Referring to FIG. 2, each of the band layers B extends in a direction intersecting the web W across the full width of the web W. The band layers B are arranged at predetermined intervals in a travelling direction, or longitudinal direction, of the web W.

The liquid burning inhibitor is an aqueous solution containing 2 to 6 percent by mass of alginic sodium, and has a viscosity ranging from 10000 to 200000 meas. More specifically, the burning inhibitor contains sodium alginates α and β below. The sodium alginates α and β have a compounding ratio ranging from 4:6 to 6:4.

α: sodium alginate with a low polymerization degree

An aqueous solution containing 1 percent by mass of α, when at a temperature of 20° C., has a viscosity of 50 mPas or less and a polymerization degree of 300 or less.

β: sodium alginate with a high polymerization degree

An aqueous solution containing 1 percent by mass of β, when at a temperature of 20° C., has a viscosity of 800 mPas or more and a polymerization degree of 600 or more.

Figure 3:
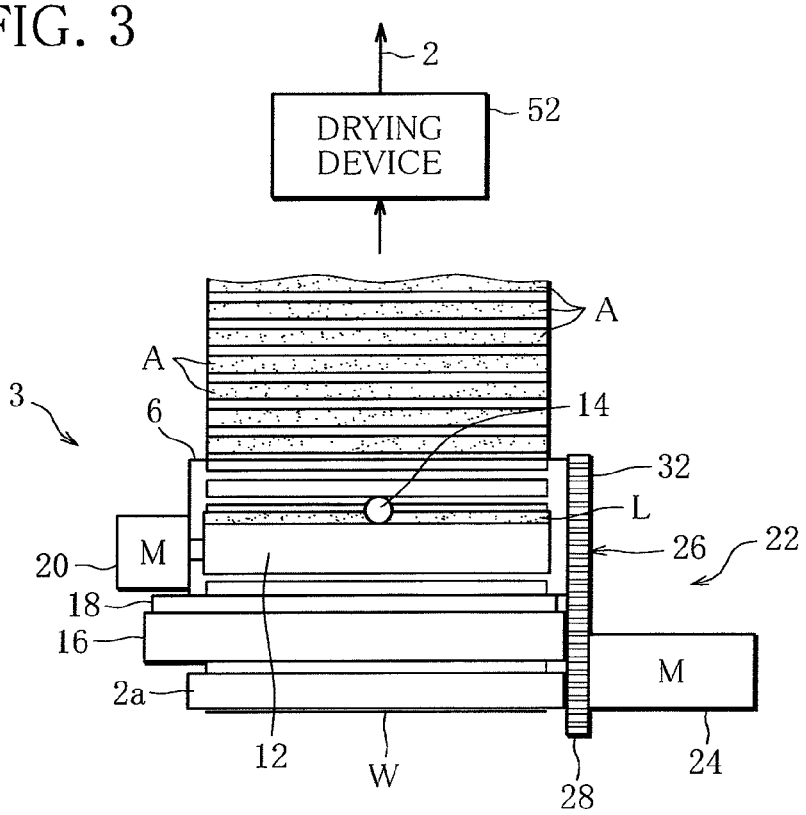
FIG. 3 is a view of the coating device of FIG. 1 as viewed from a gravure roller.

As illustrated in FIGS. 1 and 3, a furnisher roller 12 is in a rolling contact with the gravure roller 6. The furnisher roller 12 is rotatably disposed on the opposite side to the travel path 2, or in such a manner that the gravure roller 6 is sandwiched between the furnisher roller 12 and the travel path 2. The gravure roller 6 and the furnisher roller 12 define an upper nip area in cooperation with each other. An aqueous humor as a second coating liquid, or more specifically water, is supplied to the upper nip area. The upper nip area thus forms a water pool storing the supplied water. FIG. 3 shows the water accumulated in the water pool by reference mark L.

A supply pipe 14 extends from immediately above the water pool. The supply pipe 14 is connected to a water source and supplies water to the upper nip area, namely, the water pool. Underneath the furnisher roller 12, there are disposed a receiving pan 16 and a doctor blade 18. The receiving pan 16 receives water leaking out of the water pool. The doctor blade 18 comes into a sliding contact with the gravure roller 6, to thereby remove excess water that has adhered to an outer circumferential surface of the gravure roller 6. The furnisher roller 12 includes a drive motor 20 and is rotated by the drive motor 20.

Figure 4:
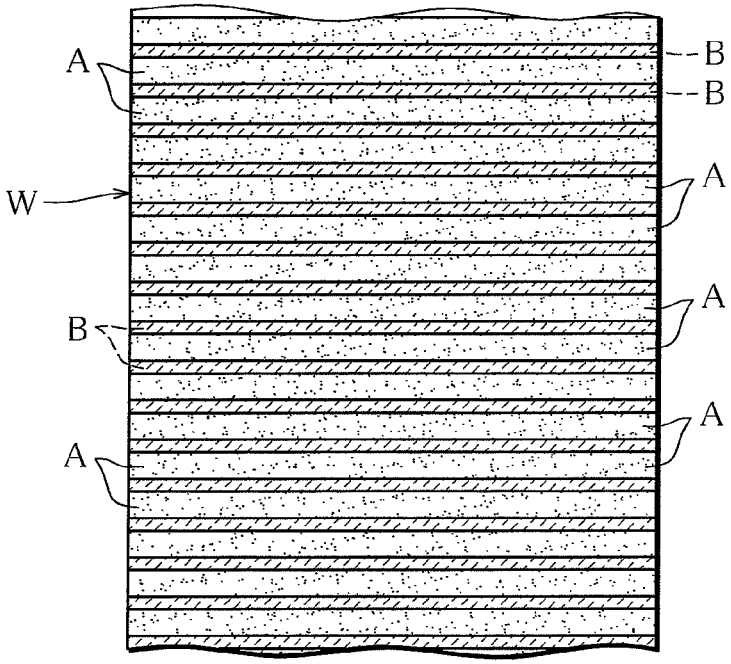
FIG. 4 is a view showing one side of a web passed through the coating device of FIG. 1.
Figure 5:
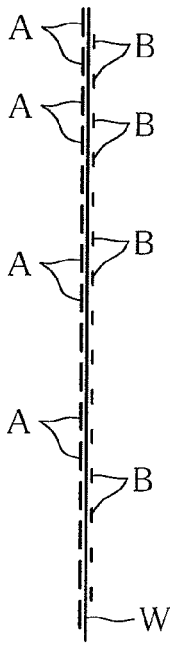
FIG. 5 is a view showing in exaggerated form the profile of the web passed through the coating device of FIG. 1.

When the band layers B are formed on one side of the web W as described above, the gravure roller 6 applies the water supplied from the water pool onto the other side of the web W in cooperation with the rotary screen 4 as a back roller, and thus forms a number of wet bands A (dotted area in FIG. 3) in the web W at the same time as the formation of the band layers B. The wet bands A also extend across the full width of the web W, and are arranged at predetermined intervals in the travelling direction of the web W. As illustrated in FIGS. 4 and 5, the band layers B and the wet bands A are alternately arranged in the longitudinal direction of the web W. For that reason, a number of recesses are formed in the outer circumferential surface of the gravure roller 6 to form the wet bands A. The recesses are arranged at predetermined intervals in a circumferential direction of the gravure roller 6.

FIGS. 2 and 3 specifically show a drive source 22 for the rotary screen 4 and the gravure roller 6. The drive source 22 includes a drive motor 24 common to the rotary screen 4 and the gravure roller 6. The drive motor 24 is connected to the rotary screen 4 and the gravure roller 6 via a gear train 26. The gear train 26 has an output gear 28 mounted on an output shaft of the drive motor 24, and drive gears 30 and 32 directly or indirectly engaged with the output gear 28. The drive gear 30 is mounted on a rotary shaft of the rotary screen 4, and the drive gear 32 is mounted on a roller shaft of the gravure roller 6.

According to the drive source 22, when the drive motor 24 is driven, the rotary screen 4 and the gravure roller 6 rotate in sync with each other, and properly form the band layers B and the wet bands A in the web W.

The travel path 2 has a drying device 52, which is placed downstream of the rotary screen 4 and the gravure roller 6. When the web W passes through the drying device 52, the drying device 52 heats both the sides of the web W, namely, the band layers B and the wet bands A, for example, up to 120° C. to 130° C. The band layers B and the wet bands A are then quickly dried. After this drying process, the web W is taken up by the take-up reel as a wrapping paper web.

Before being subjected to the drying process, the web W is substantially evenly wet because of the band layers B and the wet bands A. Even if the web W shrinks due to the drying process, therefore, the shrinkage evenly takes place all over the web W. This considerably reduces wrinkles appearing in the web after the drying process.

Since the band layers B and the wet bands A are formed in the different sides of the web W, the water contained in the wet bands A is not mixed with the liquid burning inhibitor forming the band layers B. Consequently, the formation of the wet bands A, or the application of water onto the web W, does not adversely affect the formation of the band layers B. The band layers B therefore can be properly formed.

When the wrapping paper web has the same width as cigarette wrapping paper, the wrapping paper web taken up by the take-up reel is directly fitted as a web roll to a cigarette manufacturing machine and used to manufacture cigarettes with a low ignition propensity. When the wrapping paper web is greater in width than the cigarette wrapping paper, the wrapping paper web taken up by the take-up reel is subjected to a cutting process to turn into web rolls.

The invention is not restricted by the first embodiment and may be modified in various ways.

Figure 6:
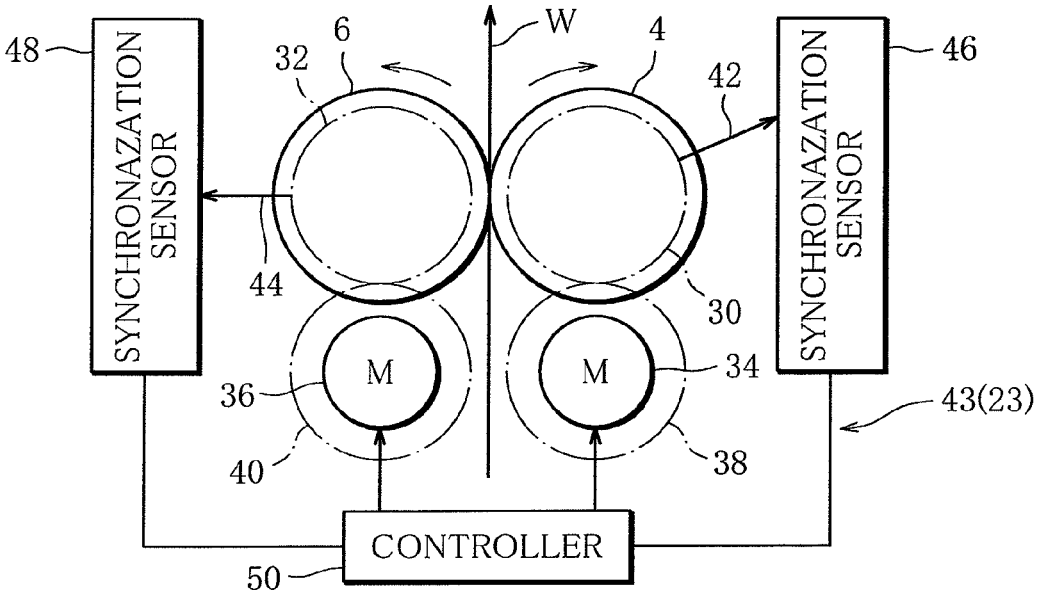
FIG. 6 is a view showing a driving source of a modification example.

For example, FIG. 6 shows a drive source 23 according to a modification example. The drive source 23 includes two servomotors 34 and 36. The servomotors 34 and 36 are provided to the rotary screen 4 and the gravure roller 6, respectively, thereby rotating the rotary screen 4 and the gravure roller 6 independently.

The servomotor 34 has an output shaft and an output gear 38 mounted on this output shaft. The output gear 38 is engaged with the drive gear 30 of the rotary screen 4. The servomotor 36 has an output shaft and an output gear 40 mounted on this output shaft. The output gear 40 is engaged with the drive gear 32 of the gravure roller 6.

When the rotary screen 4 and the gravure roller 6 are independently rotated as mentioned above, it is required to synchronize the rotations of the rotary screen 4 and the gravure roller 6 in order to properly form the band layers B and the web bands A. To that end, the drive source 23 further has a synchronization mechanism 43.

The synchronization mechanism 43 includes to-be-detected elements 42 and 44 that are fitted to outer circumferential surfaces of the drive gears 30 and 32, respectively, and indicate reference rotation angle positions of the rotary screen 4 and the gravure roller 6; synchronization sensors 46 and 48 placed near the drive gears 30 and 32, for detecting the passing of the to-be-detected elements 42 and 44; and a controller 50 for receiving detection signals from the synchronization sensors 46 and 48 and controlling at least either one of rotations of the servomotors 34 and 36.

The controller 50 determines difference between the rotations of the rotary screen 4 and the gravure roller 6 on the basis of the detection signal from the synchronization sensor 48, using the detection signal from the synchronization sensor 46 as a criterion. Based upon a result of the determination, the controller 50 controls the rotation of the servomotor 36, and thus synchronizes the rotations of the rotary screen 4 and the gravure roller 6. This enables the rotary screen 4 and the gravure roller 6 to properly form the band layers B and the wet bands A on the respective sides of the web W.

The synchronization mechanism 43 may use absolute rotary encoders (not shown), instead of the synchronization sensor 46, which are built in the servomotors 34 and 36. These rotary encoders supply to the controller 50 angle signals indicative of rotation angles of the rotary screen 4 and the gravure roller 6. Based upon the angle signals from the rotary encoders, the controller 50 synchronizes the rotations of the rotary screen 4 and the gravure roller 6.

The manufacturing machine of the invention may be interposed in a supply path of web used as wrapping paper for cigarettes with a low ignition propensity, in the above-mentioned cigarette manufacturing apparatus. Furthermore, the burning inhibitor and the aqueous humor are also not limited to those mentioned in the one embodiment.

The invention is applicable to manufacture of not only the wrapping paper web for cigarettes with a low ignition propensity but also various kinds of coating webs.

Figure 7:
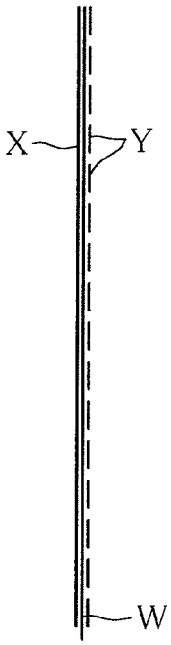
FIG. 7 is a view showing a first modification example of coating patterns.

The manufacturing machine and method according to the invention, as illustrated in FIG. 7, apply the first coating liquid onto one side of the web W to form a coating layer X on the entire one side of the web W, and apply the second coating liquid onto the other side of the web W to form a number of band layers Y on the other side of the web W. In this case, the band layers Y are arranged at predetermined intervals in the longitudinal direction of the web W.

Figure 8:
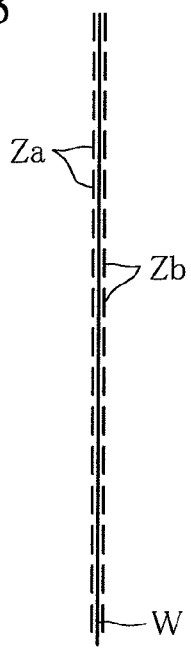
FIG. 8 is a view showing a second modification example of the coating patterns.

As illustrated in FIG. 8, the manufacturing machine and method according to the invention are capable of forming a number of band layers Za and Zb on the respective sides of the web W. In this case, the band layers Za and Zb are arranged at predetermined intervals in the longitudinal direction of the web W. The band layers Za are arranged on the opposite side of the web W to their respective band layers Zb so that the web W is sandwiched therebetween.

The manufacturing machine of the invention is not limited in combination of the rotary screen and the gravure roller. It is possible to use a combination of a plate cylinder for flexographic or offset printing and a rotary screen, or a combination of a plate cylinder for gravure, flexographic or offset printing and a plate cylinder for flexographic printing.

Furthermore, various kinds of coating liquids may be utilized as the first and second coating liquids.

REFERENCE MARKS

2 travel path
3 coating device
4 rotary screen (first applicator)
6 gravure roller (second applicator)
12 furnisher roller
22, 23 drive source
24 drive motor
26 gear train
43 synchronization mechanism
52 drying device
A wet band
B band layer (burning inhibitor)
L water (aqueous humor)
W web

The invention claimed is:

1. A coated web manufacturing machine comprising:

a travel path adapted for traveling web, said travel path including a coating position defined in said travel path, a coating device located at the coating position of said travel path, said coating device including:

a first applicator for applying a first coating liquid onto one side of the web, and a second applicator for applying a second coating liquid onto an opposite side of the web, the second coating liquid being different from the first coating liquid, and a dryer interposed in said travel path to be located downstream of said coating device, for drying the web, wherein each of the first and second applicators includes a plate cylinder for applying the first and second coating liquids onto the web, and wherein the first and second applicators alternately apply the first and second coating liquids onto the web at the coating position, such that first and second coating bands of the first and second coating liquids are arranged alternately on the opposite sides of the web, in a longitudinal direction of the web, said first coating liquid forming band layers on the one side of the web, the band layers extending in a direction intersecting the web across the full width of the web and the second coating liquid forming wet bands on the opposite side of the web, the wet bands extending in a direction intersecting the web across the full width of the web so that the band layers and the wet bands are alternately arranged in the longitudinal direction of the web reducing formation of wrinkles in the web, said band layers and the wet bands substantially evenly wet the web, the second applicator further includes a furnisher roller which is in rolling contact with the plate cylinder of the second applicator and a liquid pool defined at an upper nip area between the plate cylinder and the furnisher roller, the liquid pool storing the second coating liquid so as to supply a circumferential surface of the plate cylinder with the second coating liquid, the first coating liquid is a liquid burning inhibitor, and the second coating liquid is water, the web is wrapping paper for cigarettes, wherein the plate cylinder of the first applicator includes a rotary screen, the plate cylinder of the second applicator is a gravure roller, and wherein the first applicator and the second applicator are on the opposite sides of the web, the rotary screen of the plate cylinder of the first applicator functions as a back roller for the gravure roller, and the gravure roller of the plate cylinder of the second applicator functions as a back roller for the rotary screen of the first applicator, wherein said coating device further includes:

a drive source for rotating the rotary screen and the gravure roller in sync with each other to alternately form the band layers of the liquid burning inhibitor and the wet bands applied with the water in the longitudinal direction of the web, the drive source having a drive motor common to the rotary screen and the gravure roller, and a gear train for transmitting a drive force from the drive motor to the rotary screen and the gravure roller.

2. The coated web manufacturing apparatus according to claim 1, wherein:

the liquid burning inhibitor is an aqueous solution of sodium alginate.

3. The coated web manufacturing machine according to claim 1, wherein the second applicator further includes a supplying pipe extending above the liquid pool, the supplying pipe supplying water to the liquid pool.

4. The coated web manufacturing machine according to claim 3, wherein the second applicator further includes a drive motor rotating the furnisher roller.

5. The coated web manufacturing machine according to claim 1, wherein the travel path has a vertical portion, and the coating position is defined in the vertical portion.

6. The coated web manufacturing machine according to claim 1, wherein the gear train includes an output gear mounted on an output shaft of said drive motor, drive gears mounted on rotary shafts of the rotary screen and the gravure roller and engaged with each other, one of the drive gears being directly engaged with the output gear.

7. A coated web manufacturing machine comprising:

a travel path adapted for traveling web, said travel path including a coating position defined in said travel path, a coating device located at the coating position of said travel path, said coating device including:

a first applicator for applying a first coating liquid onto one side of the web, and a second applicator for applying a second coating liquid onto an opposite side of the web, the second coating liquid being different from the first coating liquid, and a dryer interposed in said travel path to be located downstream of said coating device, for drying the web, wherein each of the first and second applicators includes a plate cylinder for applying the first and second coating liquids onto the web, and wherein the first and second applicators alternately apply the first and second coating liquids onto the web at the coating position, such that first and second coating bands of the first and second coating liquids are arranged alternately on the opposite sides of the web, in a longitudinal direction of the web, said first coating liquid forming band layers on the one side of the web, the band layers extending in a direction intersecting the web across the full width of the web and the second coating liquid forming wet bands on the opposite side of the web, the wet bands extending in a direction intersecting the web across the full width of the web so that the band layers and the wet bands are alternately arranged in the longitudinal direction of the web for reducing formation of wrinkles in the web, said band layers and the wet bands substantially evenly wet the web, the second applicator further includes a furnisher roller which is in rolling contact with the plate cylinder of the second applicator and a liquid pool defined at an upper nip area between the plate cylinder and the furnisher roller, the liquid pool storing the second coating liquid so as to supply a circumferential surface of the plate cylinder with the second coating liquid, the first coating liquid is a liquid burning inhibitor, and the second coating liquid is water, the web is wrapping paper for cigarettes, wherein the plate cylinder of the first applicator includes a rotary screen, the plate cylinder of the second applicator is a gravure roller, and wherein the first applicator and the second applicator are on the opposite sides of the web, the rotary screen of the plate cylinder of the first applicator functions as a back roller for the gravure roller, and the gravure roller of the plate cylinder of the second applicator functions as a back roller for the rotary screen of the first applicator, wherein said coating device further includes:

a drive source for rotating the rotary screen and the gravure roller in sync with each other to alternately form the band layers of the liquid burning inhibitor and the wet bands applied with the water, the drive source having a drive motor provided to each of the rotary screen and the gravure roller, and a synchronization mechanism for synchronizing rotations of the rotary screen and the gravure roller, the synchronization mechanism having one or more sensors, and the one or more sensors detect a reference rotation angle position of the rotary screen or the gravure roller.

8. The coated web manufacturing machine according to claim 7, wherein said synchronization mechanism further includes to-be-detected elements fitted to outer circumferential surfaces of drive gears of the drive motors, respectively, the to-be-detected elements indicating the reference rotation angle position of the rotary screen and the gravure roller, the one or more sensors being placed near the drive gears, for detecting passing of the to-be-detected elements, respectively, and a controller for receiving the detection signals from the one or more sensors and controlling rotations of at least one of the motors.

9. The coated web manufacturing machine according to claim 7, wherein said synchronization mechanism includes rotary encoders as the one or more sensors provided in the drive motors, respectively, and a controller for receiving angle signals from the rotary encoders and controlling rotations of at least one of the motors.

10. The coated web manufacturing machine according to claim 7, wherein the liquid burning inhibitor is an aqueous solution of sodium alginate.

11. The coated web manufacturing machine according to claim 7, wherein the second applicator further includes a supplying pipe extending above the liquid pool, the supplying pipe supplying water to the liquid pool.

12. The coated web manufacturing machine according to claim 11, wherein the second applicator further includes a drive motor rotating the furnisher roller.

13. The coated web manufacturing machine according to claim 7, wherein the travel path has a vertical portion, and the coating position is defined in the vertical portion.

14. The coated web manufacturing machine according to claim 1, wherein the dryer heats the band layers and the wet bands between 120° C. to 130° C.

* * * * *